US010857782B2

(12) United States Patent
Tabasso et al.

(10) Patent No.: US 10,857,782 B2
(45) Date of Patent: Dec. 8, 2020

(54) THERMAL TRANSFER PRINTING MACHINE FOR PRINTING IMAGES ON ARTICLES BY MEANS OF A HEATED PAD, PARTICULARLY FOR PRINTING IMAGES IN CAVITIES OR RECESSES

(71) Applicant: EIDOS S.R.L., Turin (IT)

(72) Inventors: Giovanni Tabasso, Turin (IT); Mauro Casetta, Cuneo (IT)

(73) Assignee: EIDOS S.R.L, Chieri (IT)

( * ) Notice: Subject to any disclaimer, the term of this patent is extended or adjusted under 35 U.S.C. 154(b) by 0 days.

(21) Appl. No.: 16/323,522

(22) PCT Filed: Aug. 4, 2017

(86) PCT No.: PCT/IB2017/054787
§ 371 (c)(1),
(2) Date: Feb. 5, 2019

(87) PCT Pub. No.: WO2018/025233
PCT Pub. Date: Feb. 8, 2018

(65) Prior Publication Data

US 2019/0193389 A1 Jun. 27, 2019

(30) Foreign Application Priority Data

Aug. 5, 2016 (IT) ..... 102016000083067

(51) Int. Cl.
*B41J 33/14* (2006.01)
*B41F 16/00* (2006.01)
(Continued)

(52) U.S. Cl.
CPC ..... *B41F 16/0046* (2013.01); *B41F 16/006* (2013.01); *B41F 16/008* (2013.01);
(Continued)

(58) Field of Classification Search
CPC ... B41J 31/00; B41J 31/02; B41J 31/04; B41J 31/05; B41J 31/06; B41J 31/08;
(Continued)

(56) References Cited

FOREIGN PATENT DOCUMENTS

EP 0572999 * 12/1993 ..... B41J 3/407

* cited by examiner

*Primary Examiner* — Kristal Feggins
(74) *Attorney, Agent, or Firm* — Henry J. Cittone; Cittone Demers & Arneri LLP

(57) ABSTRACT

A thermal transfer printing machine with stationary support elements for supporting an article and a thermal transfer assembly vertically movable above the support elements, between a raised rest position and a lowered working position is disclosed. The machine has a surface heated transfer pad, supply and guide devices, a flexible printing ribbon which carries thermally transferable ink images, a position sensor providing electrical signals indicative of the vertical position of the transfer pad and a control unit with a learning phase, said control unit causes a descent run of the thermal transfer assembly, until the transfer pad engages with an article of a predetermined type. The position sensor detects and stores reference data characterizing descent run and the control unit initiates a subsequent descent run towards an article of the same type, comparing the reference data to the current descent run data, and stopping printing when an anomaly is discovered.

7 Claims, 8 Drawing Sheets

Figure 1:
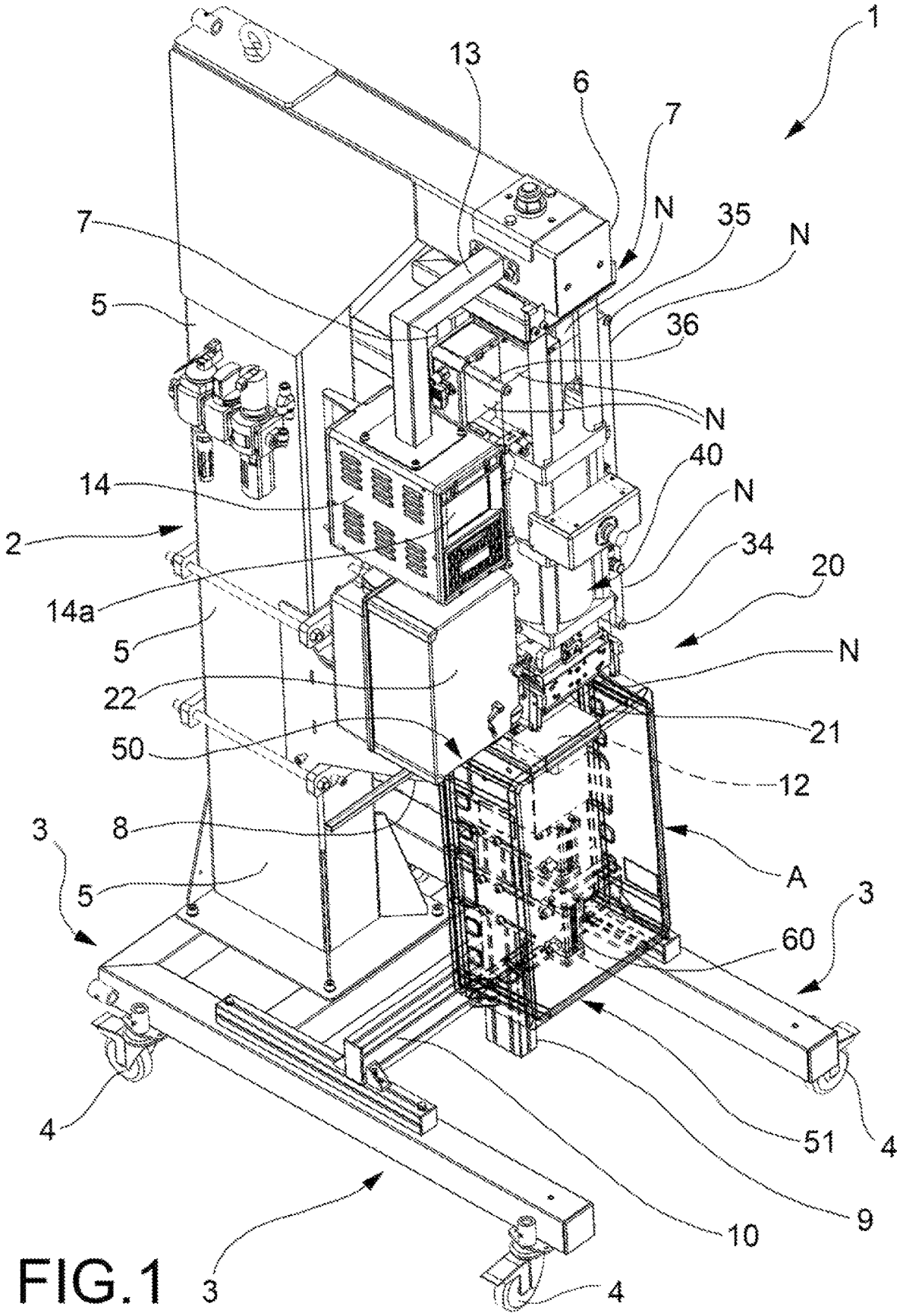

(51) Int. Cl.

| | |
|---|---|
| ***B41F 19/06*** | (2006.01) |
| ***B41F 17/24*** | (2006.01) |
| ***B41F 33/02*** | (2006.01) |
| ***B41F 33/14*** | (2006.01) |
| ***B41F 17/00*** | (2006.01) |
| ***B41F 33/04*** | (2006.01) |
| ***B41J 2/325*** | (2006.01) |
| ***B41J 17/32*** | (2006.01) |
| ***B41J 35/28*** | (2006.01) |

(52) U.S. Cl.
CPC ..... *B41F 17/002* (2013.01); *B41F 17/24* (2013.01); *B41F 19/068* (2013.01); *B41F 33/02* (2013.01); *B41F 33/04* (2013.01); *B41F 33/14* (2013.01); *B41J 2/325* (2013.01); *B41J 17/32* (2013.01); *B41J 33/14* (2013.01); *B41J 35/28* (2013.01); *B41P 2217/53* (2013.01); *B41P 2219/11* (2013.01); *B41P 2219/43* (2013.01)

(58) Field of Classification Search
CPC ... B41J 33/00; B41J 33/14; B41J 33/16; B41J 33/18; B41J 33/20; B41J 33/22; B41J 33/24; B41J 33/26; B41J 33/28
See application file for complete search history.

THERMAL TRANSFER PRINTING MACHINE FOR PRINTING IMAGES ON ARTICLES BY MEANS OF A HEATED PAD, PARTICULARLY FOR PRINTING IMAGES IN CAVITIES OR RECESSES

CROSS-REFERENCE TO RELATED APPLICATIONS

This application is the U.S. National Stage of PCT International Patent Application No. PCT/IB2017/054787, filed Aug. 4, 2017, which claims priority to Italian Patent Application No. 102016000083067, filed Aug. 5, 2016 the disclosures of each of which are incorporated herein by reference in their entireties.

The present invention generally relates to a thermal transfer printing machine for printing images on articles by means of a heated pad.

In the following description and claims, the term "image" is used to mean in a broad sense a text, a drawing, a logo, a code (such as a bar code or a two-dimensional code, for example a QR code or a Data Matrix code) or any other kind of two-dimensional graphic representation.

It is known to print codes and/or other types of images directly onto products by thermal transfer of ink from an inked ribbon.

The present invention relates in particular to a thermal transfer printing machine for printing images on articles by means of a heated pad, in particular for printing in cavities or recesses, comprising

- a frame structure, stationary in operation
- support means fixed to said frame structure and arranged to support an article on which an image is to be printed,
- a thermal transfer assembly which is placed above said support means and is movable vertically with respect to said frame structure between a raised rest position and a lowered working position, said thermal transfer assembly including a transfer pad with a lower active surface which is heated in operation, and
- supply and guide means arranged to advance, along a predetermined path extending in part between the active surface of the transfer pad and said support means, a flexible printing ribbon which on a side thereof facing said support means carries, at predetermined intervals, images formed of a thermally transferable ink.

A machine for printing images of the above-identified type is disclosed for example in European Patent No. EP 1 501 683 B1 in the Applicant's name.

It is an object of the present invention to provide a printing machine of the aforementioned type which is improved over the prior art discussed above, in particular to enable the printing of images even in cavities or recesses of articles.

This and other objects are fully achieved according to the present invention by virtue of a printing machine of the aforementioned type, characterized in that it further comprises position sensor means arranged to provide electric signals indicative of the vertical position of the transfer pad, and control means arranged to carry out

- a learning phase wherein said control means cause a descent run of the thermal transfer assembly to bring the transfer pad into engagement with an article of a determined type positioned on said support means and, via said position sensor means, detect and then store reference data characterizing said descent run, and

- a subsequent printing phase, wherein said control means cause a subsequent descent run of the thermal transfer assembly towards and up to an article of the aforementioned type positioned on said support means, detecting and comparing with said reference data the corresponding data that characterize the current descent run and stopping said printing phase when the comparison between said data is indicative of an anomaly of the current descent run.

By virtue of such features, the risk of possible damage to the transfer pad due to an impact with the article intended to receive the print when the latter is not placed in the correct position on the support means is avoided.

Figure 2:
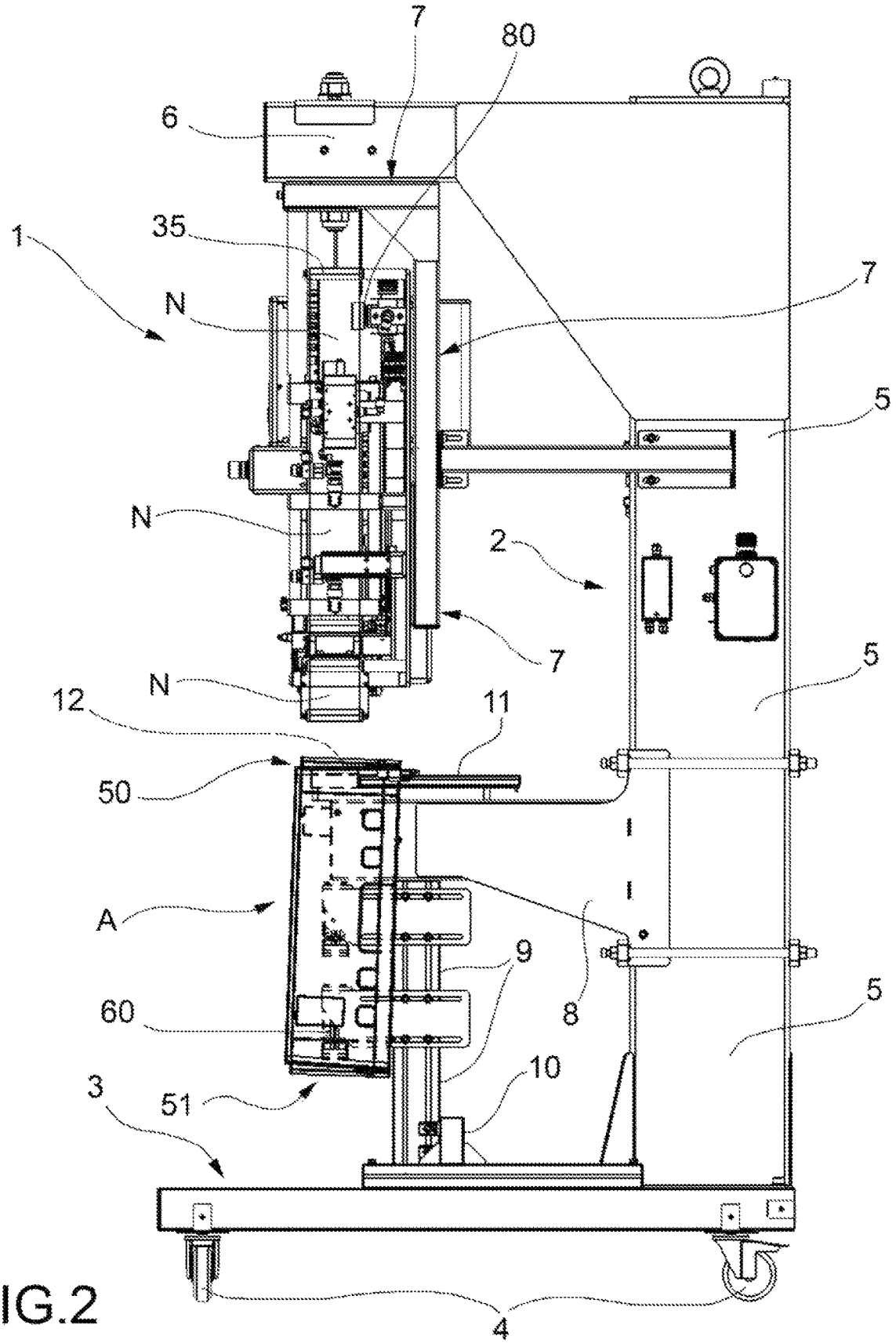
Figure 3:
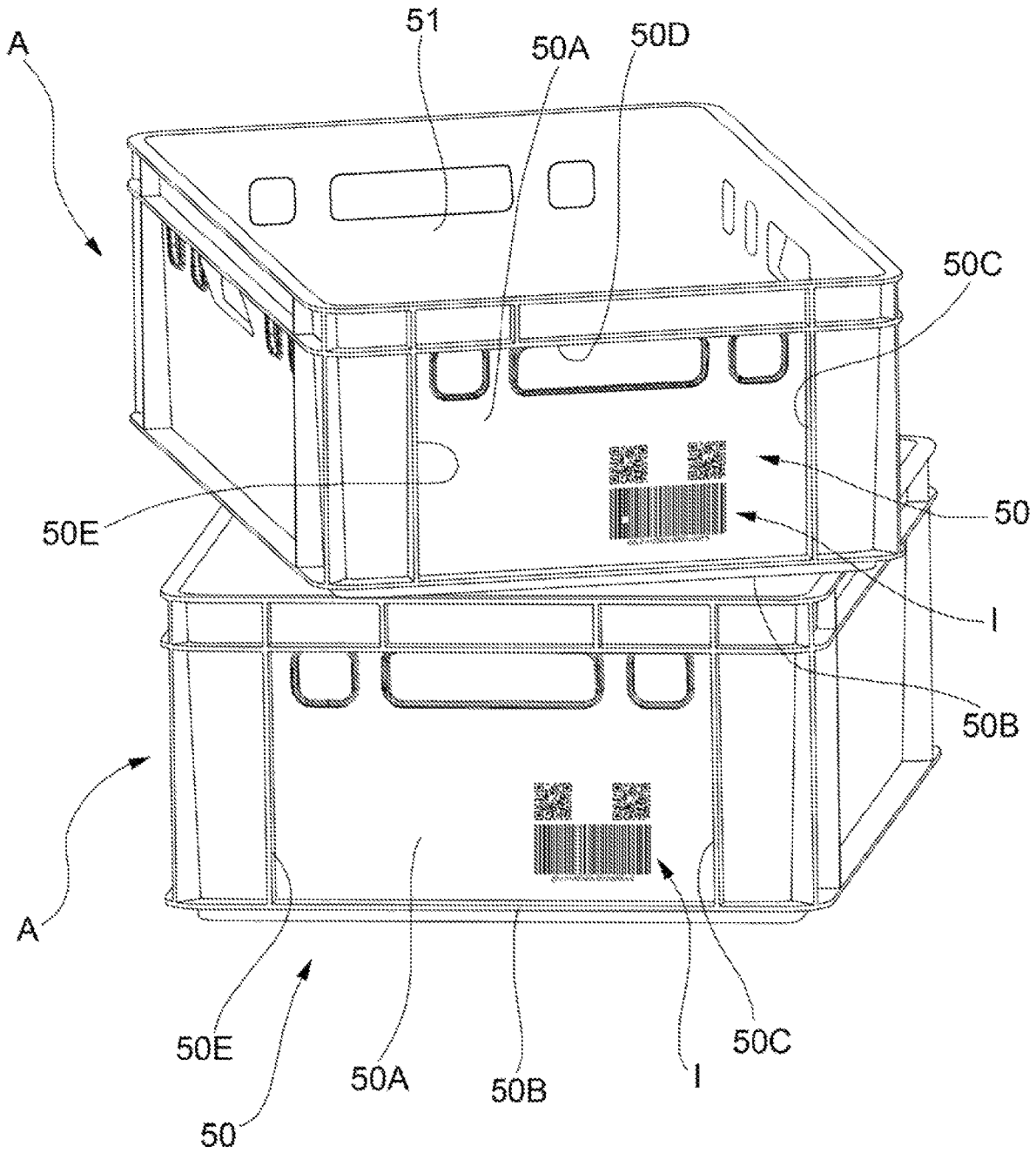
Figure 4:
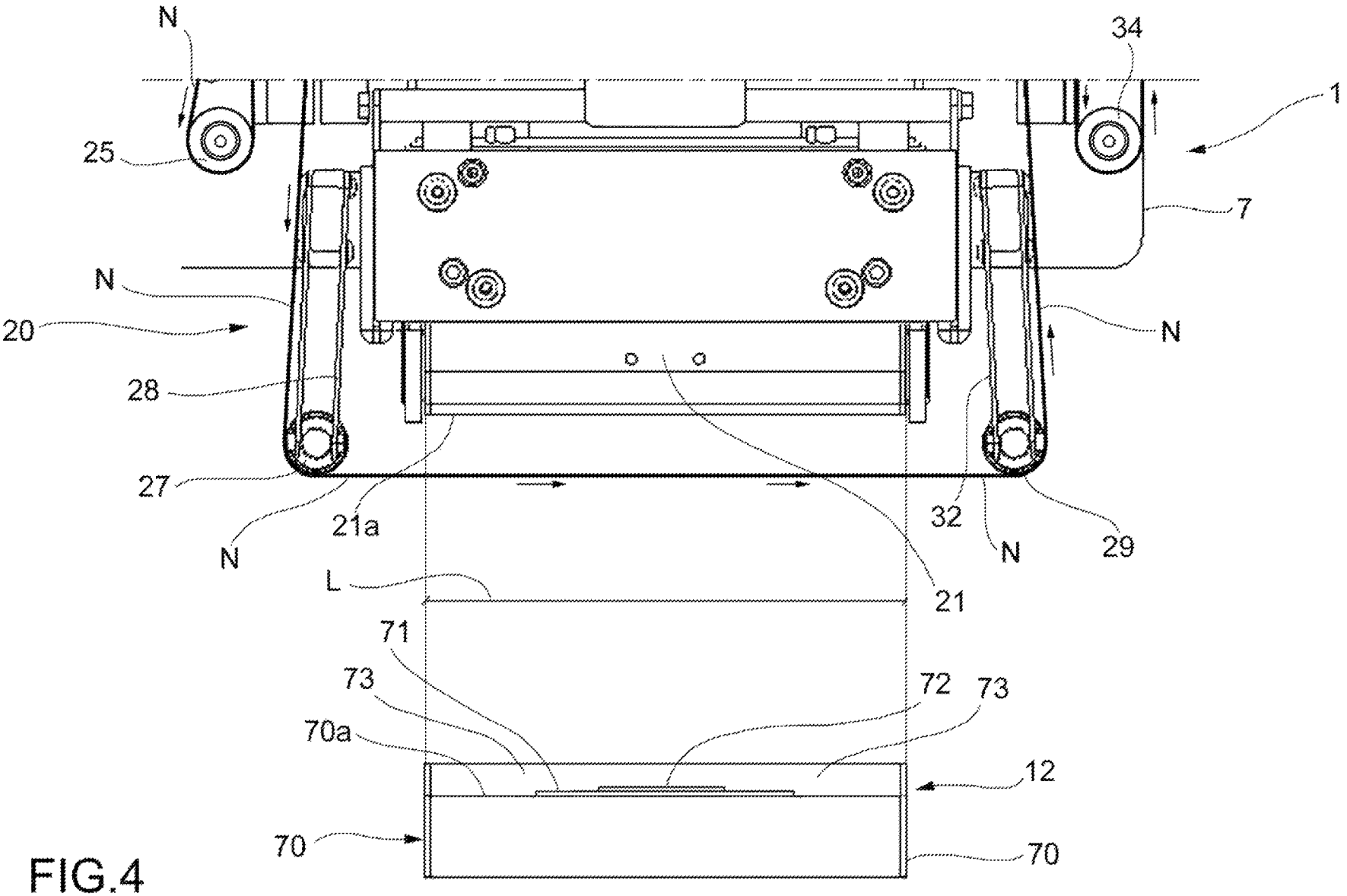
Figure 5:
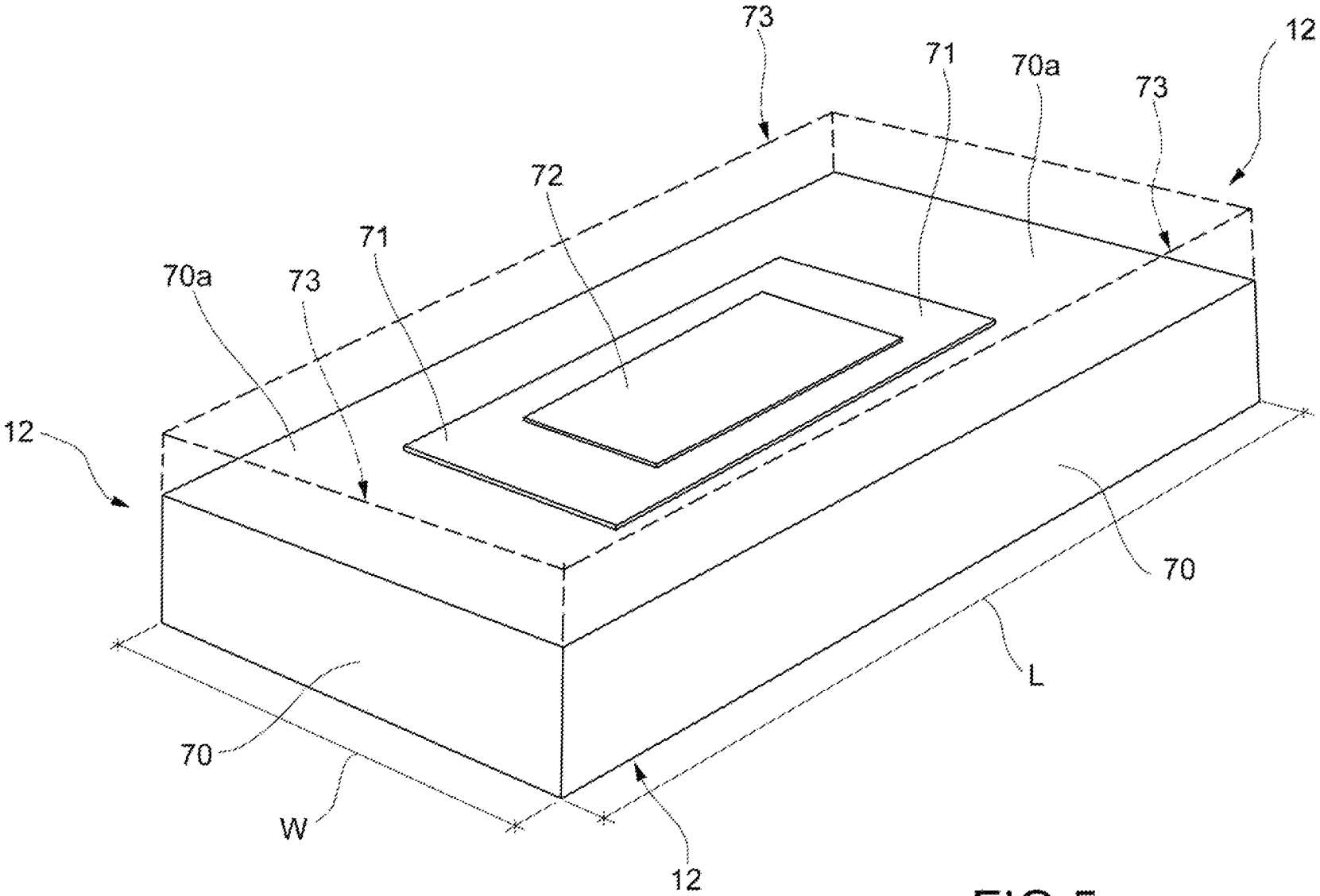
Figure 6:
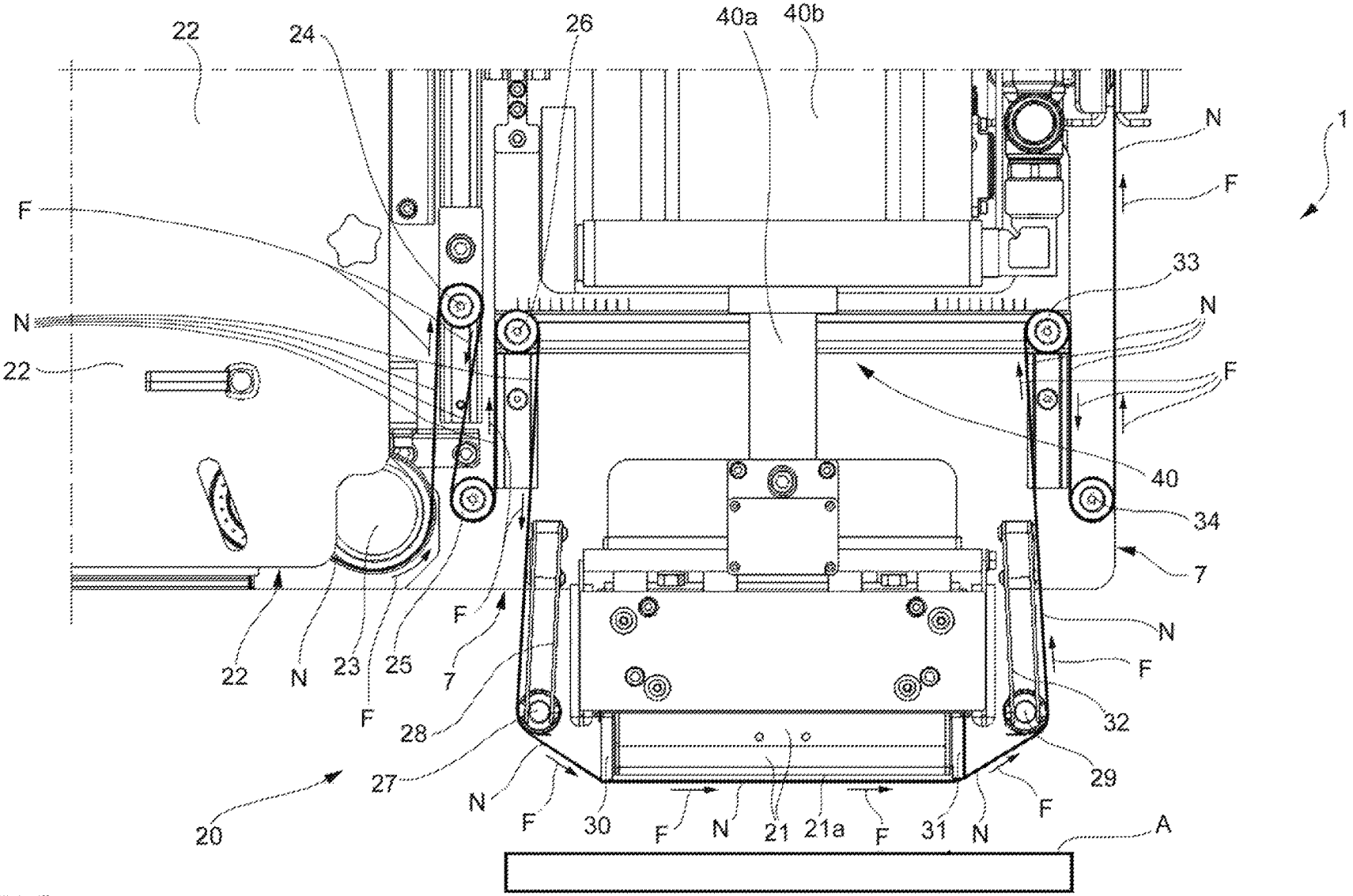
Figure 7:
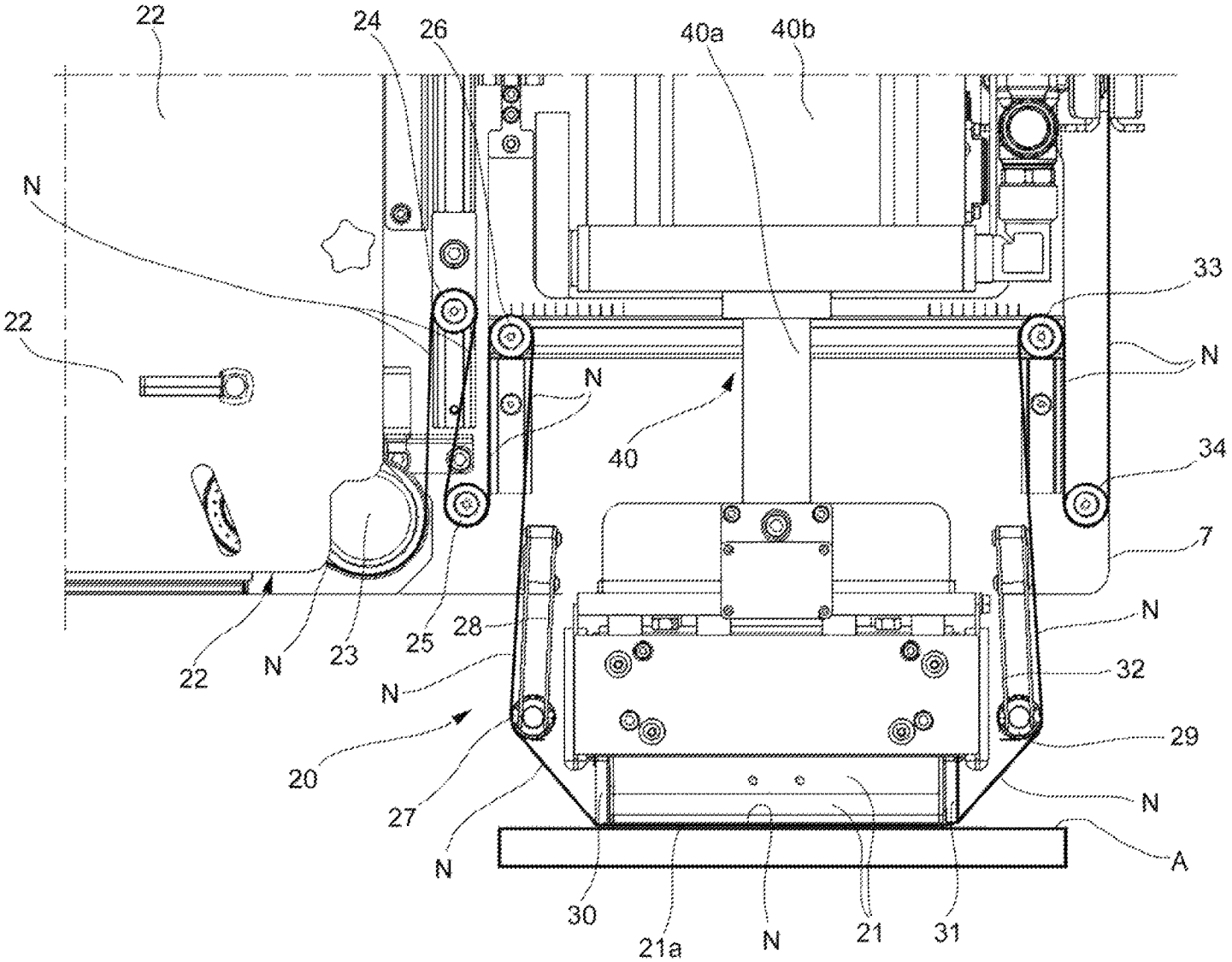
Figure 8:
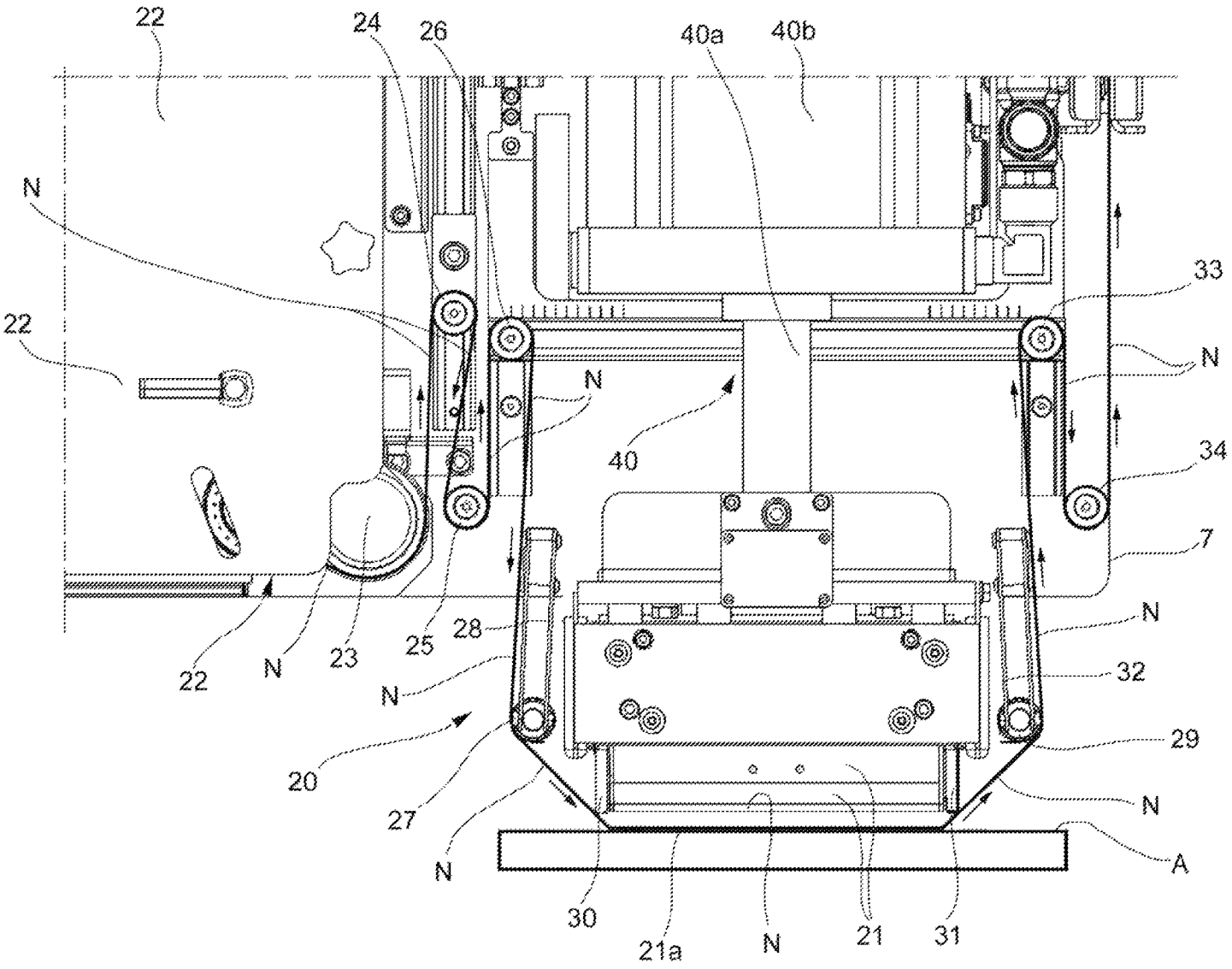

Further features and advantages of the present invention will become apparent from the following detailed description, given purely by way of non-limiting example with reference to the accompanying drawings, wherein:

FIG. 1 is a perspective view of a printing machine according to the present invention, FIG. 2 is a side view of the machine of FIG. 1, FIG. 3 is a perspective view of crates with recessed walls provided with images printed by means of a printing machine according to the present invention, FIG. 4 is a partial front view of the printing machine of FIGS. 1 and 2, FIG. 5 is a partial perspective view of support means comprised in a printing machine according to the present invention, and FIGS. 6, 7 and 8 are partial front views of a printing machine according to the invention, shown in different operating conditions.

In the drawings, a printing machine for printing images on articles by thermal transfer of ink according to the present invention is generally indicated at 1.

With reference in particular to FIG. 1 and FIGS. 6 to 8, the machine 1 comprises first of all a frame structure 2, stationary in operation.

In the illustrated embodiment, the frame structure 2 essentially comprises a carriage 3 provided with rotating and lockable wheels 4, and a column-like structure 5 secured to the carriage 3.

A partially cantilevered upper arm 6 protrudes from the top of the column-like structure 5, and a bearing and guide structure 7 is fixed under the upper arm 6 and extends vertically downwards essentially parallel to the column-like structure 5 (see in particular FIG. 2).

At a certain distance below the bearing and guide structure 7, a lower arm 8 extends in a substantially horizontal direction from the column-like structure 5.

The distal end of the lower arm 8 is reinforced by a vertical upright 9 (FIGS. 1 and 2), which is fixed under a cross-member 10 securely connected to the carriage 3.

A horizontal plate 11 (FIG. 2) is fixed over the distal end of the lower arm 8 and a support body 12, best visible in FIG. 5, is fixed onto said horizontal plate.

As will be explained in more detail hereinafter, the support body 12 is intended to allow the positioning of an article A, for example a parallelepipedal crate of plastic material, on which an image is to be printed, in the machine 1.

With reference to FIG. 1, a L-shaped arm 13, at the lower end of which an electronic control unit 14 provided frontally with a display 14*a* is fixed, extends from the upper arm 6 of the frame structure 2 of the machine 1.

In the bearing and guide structure 7 extending from the upper arm 6 of the machine 1, a thermal transfer assembly, generally indicated at 20, is mounted so as to be vertically movable. The thermal transfer assembly 20 is movable between a raised rest position, as shown in FIGS. 1, 2 and 4, and a lowered working or printing position, as shown in FIG. 7.

The thermal transfer assembly 20 includes a transfer pad, indicated at 21 in FIGS. 1, 4 and 6 through 8.

The transfer pad 21 is made for example in the manner described and illustrated in the above-cited European patent and comprises for example a block of synthetic material, for example silicone rubber, loaded with thermally conductive particles. Heating means of a type known per se, e.g. of resistive type, are provided within this block.

With reference in particular to FIGS. 1 and 6 through 8, the machine 1 further comprises a section 22, disposed adjacent to the thermal transfer assembly 20, for preparing and feeding a flexible printing ribbon N.

Such section 22 is, for example, of the type described in detail in the above-cited European Patent, and will therefore not be further described here.

In the machine 1, the printing ribbon N, which on its side intended to face the articles A carries at predetermined intervals images formed of a thermally transferable ink, follows an operative path defined by a plurality of deviation rollers, some of which are motorized.

With reference in particular to FIG. 6, this operative path is indicated by a plurality of arrows F.

Upon leaving the section 22, the printing ribbon N moves upwards from a roller 23 of this section and passes around a roller 24, then descends and passes around a roller 25, then rises up to pass around a roller 26 and finally moves downwards again.

In the thermal transfer assembly 20, the printing ribbon N is deviated by a roller 27, carried by an arm 28, and then passes between the distal ends of two resilient elements 30 and 31 mounted upstream and downstream of the transfer pad 21.

From the distal end of the resilient member 31, the printing ribbon N deviates upwards to and around a roller 29 carried by an arm 32 of the thermal transfer assembly 20.

After leaving the roller 29, the ribbon N continues almost vertically upwards and passes around a roller 33 to descend again and pass around a further roller 34.

After leaving the roller 34, the printing ribbon N moves vertically upwards to a roller 35 (FIGS. 1 and 2), then continues horizontally to a further roller 36 and then descends again towards the section 22.

In the illustrated embodiment, the thermal transfer assembly 20 is connected to the lower end of the rod 40*a* of a fluidic cylinder 40, a body 40*b* of which is attached to the support and guide structure 7 and thus to the frame structure 2 (FIGS. 6 to 8).

The thermal transfer assembly 20, and in particular the transfer pad 21, is vertically movable relative to the frame structure 2 between the raised rest position shown in FIGS. 1, 4 and 6 and the lowered working position shown in FIG. 7, in which the pad 21 is in contact engagement, under pressure, with a portion of the printing ribbon N on an underlying article A to transfer an image from such portion of the printing ribbon N to the article A.

In FIGS. 6 to 8 the article A is shown as a parallelepipedal object.

On the other hand, in FIGS. 1 and 2 the article A positioned in the machine 1 to receive the print of an image is shown as a substantially parallelepiped crate of plastic material, of a type known per se. This crate is also visible in FIG. 3.

With such articles, problems sometimes arise in printing images in recessed portions of their side walls, for example in the portions indicated at 50A of the side walls 50 of the crates A of FIG. 3.

In the example shown in FIG. 3, the recessed portions 50A of the walls 50 of the crates A are delimited by ribs 50C-50E protruding toward the outside of the crate.

In a crate of the type illustrated in FIGS. 1 to 3, the recessed portion 50A should ideally be perfectly planar. Actually, this wall often has a deviation from planarity, for example is sunken from its periphery towards its center, in the direction of the inside of the crate.

Such a configuration of the recessed portion 50A may lead to non-optimal printing results, as the transfer pad may have difficulty in applying the printing ribbon N to such surface of the recessed portion 50A and transferring to the latter the image (or images) of thermally transferable ink.

To overcome this disadvantage, a fluidic cylinder 60 is conveniently arranged on the upright 9 of the frame structure 2 (FIGS. 1 and 2), the body of the fluidic cylinder being attached to the upright 9 and the rod of the fluidic cylinder being able to engage, with its free end, from the inside of the crate A positioned on the support body 12 (FIGS. 1 and 2), a wall 51 of the crate A facing and parallel to the wall 50 which is intended to receive the printing of one or more images in the recessed portion 50A thereof.

In operation, prior to carrying out the printing of the images on the surface of the recessed portion 50A of the wall 50, the fluidic cylinder 60 is activated, in such a way that its rod urges the wall 51 of the article or crate A downwards and, consequently, causes buckling of the wall 50, and more specifically of the recessed portion 50A thereof, so as to make the surface of the latter facing the transfer pad 21 slightly convex.

Advantageously, the support body 12 shown in FIGS. 1, 2, 4 and 5 may be for this purpose made with a slightly convex upper rest surface.

In the embodiment according to FIGS. 4 and 5, the support body 12 comprises a plate-shaped base 70, for example of metal, the upper surface 70*a* of which is substantially planar. On the central portion of this surface 70*a* a thin rectangular plate 71, having, for example, a thickness of 0.1 mm, is fixed.

A further plate 72, also advantageously rectangular, with a thickness for example of 0.1 mm, is fixed above the central portion of the plate 71.

The central thickening of the upper surface 70*a* of the base 70 is therefore such that, under the pressure exerted by the transfer pad 21, the recessed portion 50A of a crate A is deformed to an arch with the ends pointing downwards, so as to compensate for any concavity of this portion in rest conditions.

With reference to FIGS. 4 and 5, an upper layer 73 of an elastically yielding material may advantageously be applied onto the base 70 and the plates 71 and 72, for example by gluing.

With reference to FIGS. 4 and 5, it is particularly advantageous that the length L and width W of the support body 12 are substantially equal to those of the transfer pad 21.

In case of images (such as the images I shown in FIG. 3) to be printed on recessed portions of articles like the crates A of FIG. 3, it is important that such articles be correctly positioned on the support body 12 in order to avoid damage to the transfer pad 21.

In fact, if a crate A is positioned on the support body 12 so that, during the printing phase, the transfer pad 21 will impact one or more of the ribs 50C-50E, the transfer roller 21 may be seriously damaged.

In order to avoid the occurrence of such an inconvenience, a position sensor 80 (FIG. 2), such as a rotary encoder, is advantageously associated with the thermal transfer assembly 20 and is operatively coupled to a part of this assembly which is drivingly connected for vertical translation with the transfer pad 21. The position sensor 80 is advantageously connected to the electronic control unit 14 of the machine 1.

The electronic control unit 14 is arranged to carry out an initial learning phase wherein the unit 14 causes a descent run of the thermal transfer assembly 20 and the transfer pad 21, until the latter is brought into engagement with the surface of a predetermined article A positioned on the support body 12, and by means of the position sensor 80 detects and then stores reference data characterizing said descent run, e.g. the speed profile of the transfer pad 21 over time, and a subsequent printing phase wherein the unit 14 causes a subsequent descent run of the thermal transfer assembly 20 and the transfer pad 21 towards and up to a new article A of the same type positioned on the support body 12.

During this printing phase, the electronic control unit 14 detects and compares, with the aforementioned reference data previously acquired, the corresponding data characterizing the current descent run and stops the printing phase when the comparison of such data reveals an anomaly in the current descent run.

By virtue of this learning procedure, damages to the transfer roller 21 are avoided.

In a printing phase the machine 1 according to the invention essentially operates as follows.

When the machine 1 is at rest, it has the configuration shown in FIGS. 1 and 6, wherein the thermal transfer assembly 20 is in the raised rest position and in such condition the portion of the printing ribbon N held between the rollers 27 and 29 is kept by the resilient members 30 and 31 at a distance from the lower active surface 21*a* of the transfer pad 21 (FIG. 4).

In view of printing an image on an article A, the electronic control unit 14 of the machine 1 determines the positioning, between the rollers 27 and 29, of a portion of the printing ribbon N carrying the image formed of a thermally transferable ink intended to be printed on the article A.

The thermal transfer assembly 20 and the transfer pad 21 are then displaced downwards by activation of the fluidic cylinder 40. During this descent, the transfer roller 21, always at a distance from the printing ribbon N, is kept heated.

When the thermal transfer assembly 20 is close to the article A, as shown in FIG. 6, the assembly formed by the transfer pad 21 and the associated resilient elements 30 and 31 descends below the level of the rollers 27 and 29, but the portion of the printing ribbon N that carries the image of thermal transferable ink is still kept at a distance from the transfer pad 21 by the resilient elements 30 and 31, which protrude sufficiently downwards relative to the lower active surface 21*a* of this pad.

The thermal transfer assembly 20 then reaches the working position shown in FIG. 7, wherein the resilient elements 30 and 31 impact against the surface of the article A and are resiliently compressed in the vertical direction, so that the transfer pad 21 with its lower active surface 21*a* may press the printing ribbon N against the surface of the article A to print thereon the image or images of thermal transferable ink.

Upon completion of the printing phase, the electronic control unit 14 causes the thermal transfer assembly 20 to move upwards via the fluidic actuator 40.

As soon as the transfer pad 21 is at a sufficient distance from the article A, the resilient elements 30 and 31 re-expand downwards, helping to determine the detachment of the printing ribbon N from the lower active surface 21*a* of the transfer pad 21, as shown in FIG. 8.

The thermal transfer assembly 20 may then return back to the raised rest position to be able to carry out a new printing phase.

The machine according to the present invention has a very safe operation, in particular with regard to the prevention of damages caused by the transfer pad and the release of the printing ribbon from the articles.

Naturally, the principle of the invention remaining unchanged, the embodiments and manufacturing details may widely vary compared to those described and illustrated purely by way of a non-limiting example, without thereby departing from the scope of the invention as defined in the accompanying claims.

The invention claimed is:

1. A printing machine for thermal transfer printing of images (I) on articles (A), comprising a frame structure, stationary in operation, one or more support elements fixed to the frame structure and arranged to support the article (A) on which at least one image (I) is to be printed, a thermal transfer assembly with a transfer pad having an active surface which is heated in operation, the thermal transfer assembly being placed above said support elements and being movable vertically relative to the frame structure between a raised rest position and a lowered working position, an actuator arranged to cause a vertical translational movement of the thermal transfer assembly relative to the frame structure between said raised rest position and lowered working position, and supply and guide elements arranged to advance, along a predetermined path extending in part between the active surface of the transfer pad and said support elements, a flexible printing ribbon (N) which on a side thereof facing said support elements carries, at predetermined intervals, images (I) formed of a thermally transferable ink, wherein the printing machine further comprises a position sensor arranged to provide electric signals indicative of a vertical position of the transfer pad, and a control unit arranged to carry out a learning phase wherein said control unit causes a subsequent descent run of the thermal transfer assembly until the transfer pad is brought into engagement with a first article (A) of a predetermined type positioned on said support elements, and through said position sensor detect and store reference data characterizing said descent run, and a subsequent printing phase, wherein said control unit causes a subsequent descent run of the thermal transfer assembly, towards and up to a second article (A), of the same type as said first article (A), positioned on the support elements, detecting and comparing with said reference data corresponding data which characterize the current descent run, and stopping said printing phase when the comparison of said data is indicative of an anomaly in the current descent run.

2. The printing machine according to claim 1, wherein said position sensor comprises a rotary encoder coupled with a member drivingly connected with said thermal transfer assembly.

3. The printing machine according to claim 1, wherein the thermal transfer assembly further comprises first and second horizontal deviation rollers, parallel with one another, arranged one upstream and the other one downstream of the transfer pad along the path of said printing ribbon (N), in such a manner that in operation a portion of the printing ribbon (N) carrying at least one image (I) to be printed is held under the transfer pad between said first and second deviation rollers, and resilient elements protruding downwardly relative to the active surface of the transfer pad when the thermal transfer assembly moves between said rest position and said working position, said resilient elements being configured to engage the printing ribbon (N) between said first and second deviation rollers, upstream and downstream of the active surface of the transfer pad, and to be resiliently compressed when the transfer pad reaches said working position and engages said portion of the printing ribbon (N), and to re-expand resiliently, cooperating to detach the printing ribbon (N) from the transfer pad, when the transfer pad is moved to said rest position upon completion of a printing operation.

4. The printing machine according to claim 1, wherein said support elements comprise a support body drivingly connected with the frame structure and having an upper convex rest surface which faces the active surface of the transfer pad and on which a side wall of the article (A), such as a flexible side wall of a crate of plastic material, is to be placed with a recessed portion of said side wall facing the transfer pad.

5. The printing machine according to claim 4, wherein on the rest surface of the support body there is disposed a layer of resiliently compressible material.

6. The printing machine according to claim 4, wherein the support body has transverse dimensions (L, W) corresponding to those of the transfer pad.

7. The printing machine according to claim 4, wherein the frame structure is provided with deformation devices arranged to engage a second side wall of the article (A) facing at a distance a first side wall, with said first side wall resting on the support body, and to cause a deformation of said first side wall such as to reduce any concavities of said first side wall facing upwards.

* * * * *